US010696523B2

(12) United States Patent
Ollila

(10) Patent No.: US 10,696,523 B2
(45) Date of Patent: Jun. 30, 2020

(54) CONTROL DEVICE AND METHOD FOR CONTROLLING MOTION OF A LOAD

(71) Applicant: Vacon Oy, Vaasa (FI)

(72) Inventor: Jaakko Ollila, Pirkkala (FI)

(73) Assignee: Vacon Oy, Vaasa (FI)

( * ) Notice: Subject to any disclaimer, the term of this patent is extended or adjusted under 35 U.S.C. 154(b) by 253 days.

(21) Appl. No.: 15/955,141

(22) Filed: Apr. 17, 2018

(65) Prior Publication Data

US 2019/0315601 A1 Oct. 17, 2019

(51) Int. Cl.
*B66C 13/06* (2006.01)

(52) U.S. Cl.
CPC ..... *B66C 13/063* (2013.01)

(58) Field of Classification Search
CPC ..... B66C 13/063
See application file for complete search history.

(56) References Cited

U.S. PATENT DOCUMENTS 5,359,542 A * 10/1994 Pahmeier ..... B25J 9/1615 356/621
5,495,955 A * 3/1996 Shibata ..... B66C 13/063 212/275
5,960,969 A * 10/1999 Habisohn ..... B66C 13/063 212/270
7,367,464 B1 * 5/2008 Agostini ..... B66C 13/063 212/308
9,385,737 B1 * 7/2016 Yu ..... H03M 1/0624
2004/0006930 A1 * 1/2004 Fahrion ..... B64F 5/40 52/64
2008/0110844 A1 * 5/2008 Lewis ..... B66C 13/48 212/285
2009/0030647 A1 * 1/2009 Stocker ..... G01B 11/002 702/152
2009/0164345 A1 * 6/2009 Pierce ..... G05B 15/02 705/29
2010/0145526 A1 * 6/2010 Yamaguchi ..... B66C 13/40 700/275

(Continued)

FOREIGN PATENT DOCUMENTS

CN 103998367 A 8/2014
CN 106927366 A 7/2017

(Continued)

*Primary Examiner* — Hussein Elchanti
(74) *Attorney, Agent, or Firm* — McCormick, Paulding & Huber PLLC

(57) ABSTRACT

A control device for controlling motion of a load of a carrier device is presented. The carrier device can be for example a crane and the load can be carried with a rope connected to a suspension point of the crane. The control device comprises an input interface for receiving an input signal indicative of a target speed of the load, an output interface for submitting an output signal indicative of a reference speed of the suspension point, and a processing system constituting a signal processing path for producing the output signal based on the input signal. The signal processing path comprises at least one finite impulse response filter for suppressing a signal component whose frequency is the natural swinging frequency of the load. Due to the finite impulse response, the temporal length of settling and tail effects caused by the filter is limited and deterministic.

19 Claims, 5 Drawing Sheets

(56) References Cited

U.S. PATENT DOCUMENTS

| | | | | |
|---|---|---|---|---|
| 2010/0181165 | A1* | 7/2010 | Finn | B23K 26/0876 198/339.1 |
| 2011/0076130 | A1* | 3/2011 | Stocker | B66C 13/46 414/815 |

FOREIGN PATENT DOCUMENTS

| | | | |
|---|---|---|---|
| CN | 106959610 | A | 7/2017 |
| WO | 94/11293 | A1 | 5/1994 |

* cited by examiner

CONTROL DEVICE AND METHOD FOR CONTROLLING MOTION OF A LOAD

TECHNICAL FIELD

The disclosure relates generally to motion control. More particularly, the disclosure relates to a device and to a method for controlling motion of a load that is non-rigidly connected to a suspension point whose speed and position are controllable. Furthermore, the disclosure relates to system for handling a load. The system can be, for example but not necessarily, a crane. Furthermore, the disclosure relates to a computer program for controlling motion of a load non-rigidly connected to a suspension point whose speed and position are controllable.

BACKGROUND

Unwanted swinging is a problem that affects performance of many mechanical systems where a load is non-rigidly connected to a suspension point whose speed and position are controlled. For example, when the suspension point is moved the load has tendency to swing. The tendency to swing may represent a risk of damaging the load and/or its surroundings, and/or may decrease productivity by forcing the mechanical system to be operated slowly. The mechanical system can be for example a crane comprising a crane carriage from which, by means of a suspension rope, a load is suspended. A crane operator gives a speed instruction via a control terminal connected to a control unit which controls speed of the crane carriage. In crane applications of the kind mentioned above, load swinging is a problem especially in automatic cranes as well as in cranes without a skilled person controlling the load motion.

It is a known fact that load swinging can be reduced by increasing acceleration and deceleration ramp times and using long S-curve speed shaping, i.e. limiting the time-derivative of acceleration i.e. limiting the jerk. An inherent challenge of this approach is that response and settling times may increase to an unacceptable level.

Another approach is to use a swinging angle sensor and to utilize an output signal of the swinging angle sensor in model-based control of load motion. The model can be based on motion equations according to the classical Newtonian dynamics. In many cases there is, however, a desire to avoid instrumentations such as a swinging angle sensor which may be susceptible to damages in harsh environmental conditions under which a crane may sometimes have to operate.

There are published open-loop methods which do not need a swinging angle sensor, and which are based on a pendulum model based on the classical Newtonian dynamics. An exemplifying open-loop method based on a pendulum model is described in the publication WO9411293. A challenge related to these open-loop methods is their sensitivity to errors in model parameters such as rope length and a distance between a hook and the center of mass of a load.

SUMMARY

The following presents a simplified summary to provide a basic understanding of some aspects of different invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying and non-limiting embodiments of the invention.

In accordance with the invention, there is provided a new control device for controlling motion of a load that is non-rigidly connected to a suspension point whose speed and position are controllable. The suspension point can be, for example but not necessarily, a part of a crane and the load can be suspended with a suspension rope from the suspension point.

A control device according to the invention comprises an input interface for receiving an input signal indicative of a target speed of the load, an output interface for submitting an output signal indicative of a reference speed of the suspension point, and a processing system constituting a signal processing path for producing the output signal based on the input signal, wherein signal processing path comprises at least one finite impulse response "FIR" filter for suppressing a signal component whose frequency is a natural swinging frequency of the load.

Thanks to the above-mentioned at least one finite impulse response filter, the speed of the suspension point has substantially no frequency component to excite the swinging of the load. As the above-mentioned filter has a finite impulse response, the temporal length of settling and tail effects caused by the filter is limited and deterministic. To improve robustness against variation in properties of the non-rigid connection, e.g. against variation in rope length, the signal processing path is advantageously arranged to have a stop-band whose width covers a range of variation of the natural swinging frequency.

In accordance with the invention, there is provided also a new system for handling a load. A system according to the invention comprises a carrier device comprising a suspension point for carrying the load non-rigidly connected to the suspension point, and a controllable drive for moving the suspension point, and a control device according to the invention for receiving an input signal indicative of a target speed of the load and for supplying, to the controllable drive, an output signal indicative of a reference speed of the suspension point.

The above-mentioned carrier device can be for example a crane for carrying the load with a suspension rope connected to the suspension point.

In accordance with the invention, there is provided also a new method for controlling motion of a load that is non-rigidly connected to a suspension point whose speed and position are controllable. A method according to the invention comprises; receiving an input signal indicative of a target speed of the load, supplying the input signal to a signal processing path for producing an output signal indicative of a reference speed of the suspension point, and controlling motion of the suspension point in accordance with the output signal of the signal processing path, wherein the signal processing path comprises at least one finite impulse response filter for suppressing a signal component whose frequency is a natural swinging frequency of the load.

In accordance with the invention, there is provided also a new computer program for controlling motion of a load that is non-rigidly connected to a suspension point whose speed and position are controllable. A computer program according to the invention comprises computer executable instructions for controlling a programmable processor to constitute a signal processing path, receive an input signal indicative of a target speed of the load, supply the input signal to the signal processing path to produce an output signal indicative of a reference speed of the suspension point, and control motion of the suspension point in accordance with the output signal of the signal processing path, wherein the computer program comprises computer executable instructions for configuring the signal processing path to comprise at least one finite impulse response filter for suppressing a signal component whose frequency is a natural swinging frequency of the load.

In accordance with the invention, there is provided also a new computer program product. The computer program product comprises a non-volatile computer readable medium, e.g. a compact disc "CD", encoded with a computer program according to the invention.

Various exemplifying and non-limiting embodiments of the invention are described in accompanied dependent claims.

Exemplifying and non-limiting embodiments of the invention both as to constructions and to methods of operation, together with additional objects and advantages thereof, are best understood from the following description of specific exemplifying embodiments when read in conjunction with the accompanying drawings.

The verbs "to comprise" and "to include" are used in this document as open limitations that neither exclude nor require the existence of un-recited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF FIGURES

Exemplifying and non-limiting embodiments of the invention and their advantages are explained in greater detail below with reference to the accompanying drawings, in which.

DETAILED DESCRIPTION

The specific examples provided in the description below should not be construed as limiting the scope and/or the applicability of the accompanied claims. Lists and groups of examples provided in the description below are not exhaustive unless otherwise explicitly stated.

Figure 1:
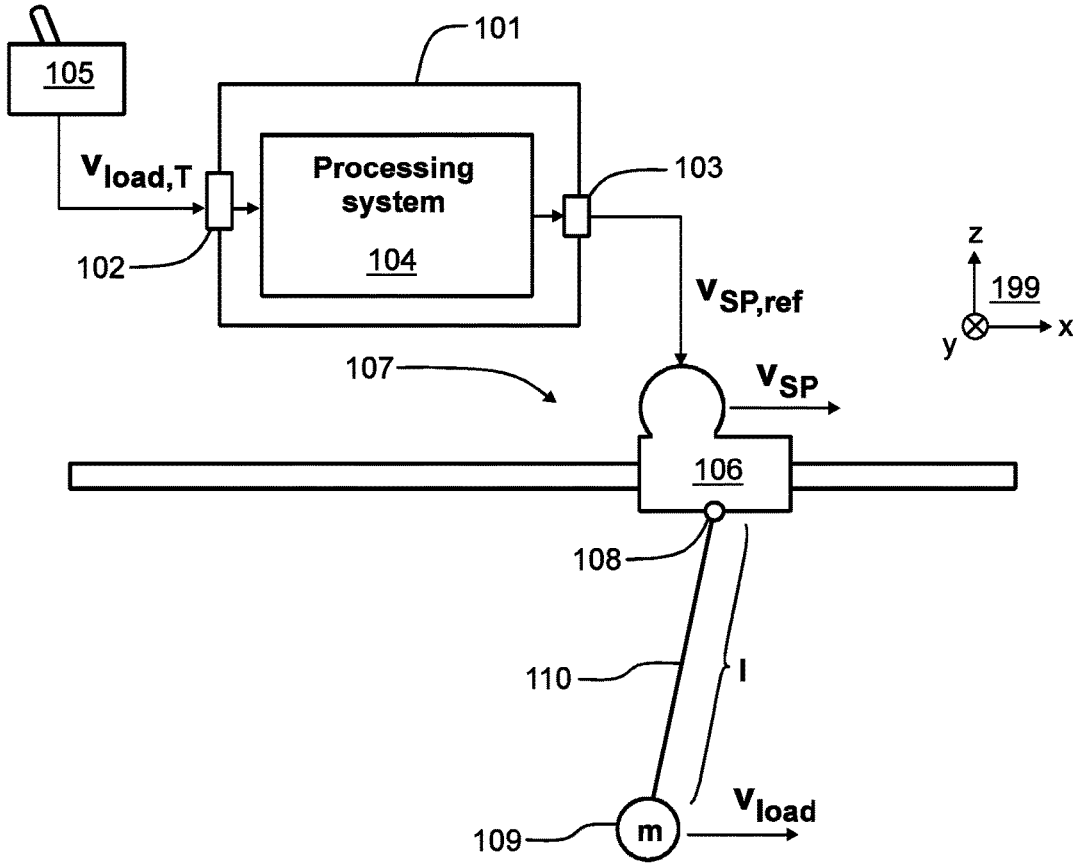
FIG. 1 illustrates a system according to an exemplifying and non-limiting embodiment of the invention for handling a load.

FIG. 1 illustrates a system according to an exemplifying and non-limiting embodiment of the invention for handling a load 109. The system comprises a carrier device 107 comprising a suspension point 108 for carrying the load 109 non-rigidly connected to the suspension point. The carrier device 107 comprises a controllable drive 106 for moving the suspension point 108 in positive and negative directions of the x-axis of a coordinate system 199. In this exemplifying case, the carrier device 107 is a crane for carrying the load 109 with a suspension rope 110 connected to the suspension point 108. The system comprises a control device 101 according to an exemplifying and non-limiting embodiment of the invention for controlling the controllable drive 106 in accordance with an input signal given by a control terminal 105. In this exemplifying case, the input signal is a target speed $v_{load,T}$ of the load 109. In FIG. 1, the actual speed of the load 109 is denoted as $v_{load}$. It is also possible that the input signal is e.g. a target position or a target acceleration which is indicative of the target speed of the load 109 via a known mathematical relation.

The control device 101 comprises an input interface 102 for receiving the input signal indicative of the target speed of the load 109. The control device 101 comprises an output interface 103 for submitting, to the controllable drive 106, an output signal indicative of a reference speed $v_{SP,ref}$ of the suspension point 108. In this exemplifying case, the output signal is the reference speed $v_{SP,ref}$ of the suspension point 108. It is also possible that the output signal is e.g. a reference position or a reference acceleration which is indicative of the reference speed of the suspension point 108 via a known mathematical relation. In FIG. 1, the actual speed of the suspension point 108 is denoted as $v_{SP}$. The control device 101 comprises a processing system 104 constituting a signal processing path for producing the output signal based on the input signal. The signal processing path comprises a finite impulse response "FIR" filter for suppressing a signal component whose frequency is a natural swinging frequency of the load 109. Therefore, the speed $v_{SP}$ of the suspension point 108 has substantially no frequency component to excite the swinging of the load 109. As the above-mentioned filter has a finite impulse response, the temporal length of settling and tail effects caused by the filter is limited and deterministic.

Figure 2A:
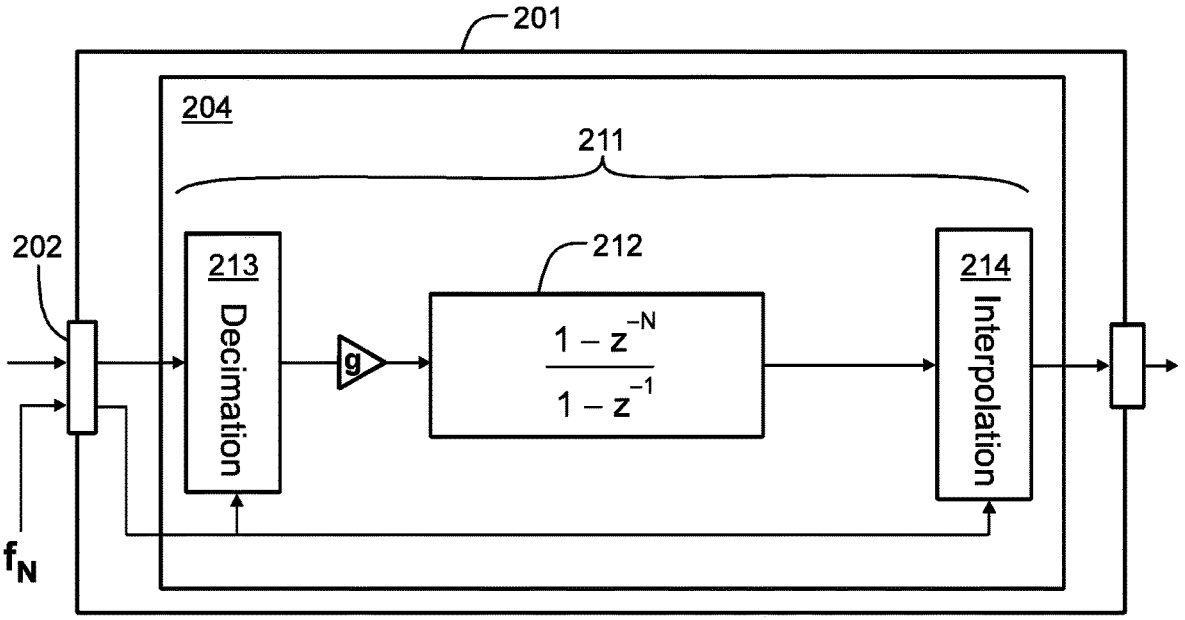
FIGS. 2*a* and 2*b* illustrate a control device according to an exemplifying and non-limiting embodiment of the invention for controlling motion of a load.

FIG. 2*a* illustrates a control device 201 according to an exemplifying and non-limiting embodiment of the invention. The control device 201 comprises a processing system 204 constituting a signal processing path 211. In this exemplifying case, the signal processing path 211 comprises a finite impulse response "FIR" filter 212 that is a moving average filter whose z-domain transfer function is $1+z^{-1}+Z^{-2}+Z^{-3}+\ldots+Z^{-(N-1)}$. The zero-frequency gain, i.e. the DC-gain, of the FIR-filter 212 is N since z=1 at DC. The signal processing path 211 comprises a gain g for setting a total gain of the signal processing path 211 to be at a suitable level. The gain g can be for example 1/N to compensate for the DC-gain of the FIR-filter 212. The signal processing path 211 further comprises a decimator 213 in front of the FIR-filter 212 and an interpolator 214 after the FIR-filter 212. The decimator 213 makes a sample rate of the FIR-filter 212 to be less than a sample rate of the input signal, and the interpolator 214 makes a sample rate of the output signal to be greater than the sample rate of the FIR-filter 212. Advantageously, the interpolator 214 includes a filter for suppressing, from the output signal of the control device 201, images of the output spectrum of the FIR-filter 212. The decimator 213 can be provided with an anti-aliasing filter for preventing aliasing effect in the output signal of the decimator 213.

Figure 2B:
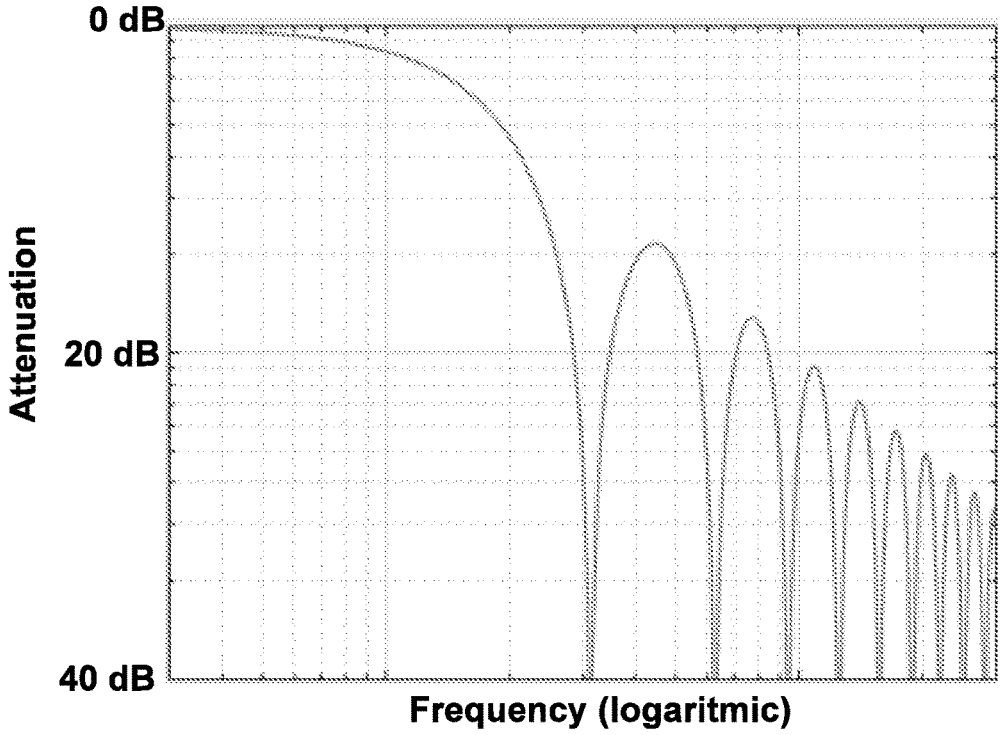

An amplitude response, i.e. the absolute value of a frequency response, of the signal processing path 211 is shown in FIG. 2*b*. Locations of transfer-zeros, i.e. zero points of the amplitude response, on the frequency axis depend on the sample rate $f_s$ of the input signal of the control device 201, on the length N of the FIR-filter 212, and on the decimation ratio $N_D$ so that the frequencies of the transfer zeroes are $n \times f_s/(N \times N_D)$, where n is a non-zero integer number. The interpolation ratio does not have a similar effect on the frequencies of the transfer-zeros because, in principle, interpolation adds interpolating values between successive values of the time-discrete output signal of the FIR-filter 212 but does not change the sample rate of the FIR-filter 212. In an exemplifying case, the sample rate of the input signal of the control device 201 is 1 kHz, the length N of the FIR-filter 212 is 100, and the decimation ratio is 40. In this exemplifying case, the temporal length of the FIR-filter 212 is 100×40×1 ms=4 seconds and thus the FIR-filter 212 has transfer-zeros at frequencies n×0.25 Hz, n being a non-zero integer number. The first transfer-zero frequency 0.25 Hz is substantially the natural swinging frequency $f_N$ of the load 109 when the length of the suspension rope 110 is about 4 meters. The natural swinging frequency $f_N$ can be estimated with the following equation:

$$f_N = \frac{1}{2\pi}\sqrt{\frac{g}{l}}, \tag{1}$$

where g is the acceleration of gravity=9.82 m/s$^2$ and l is the length of the suspension rope 110. The frequency of the first transfer-zero of the FIR-filter 212 is advantageously selected to be the same as or slightly smaller than the minimum natural swinging frequency i.e. the natural swinging frequency corresponding to the maximum length of the suspension rope 110.

In a control device according to an exemplifying and non-limiting embodiment of the invention, the input interface 202 of the control device is configured to receive data indicative of the natural swinging frequency $f_N$. The processing system 204 is configured to change the decimation ratio $N_D$ of the decimator 213 in accordance with a change of the natural swinging frequency. The above-mentioned data can express for example the value of the natural swinging frequency $f_N$ or the length l of the suspension rope 110 based on which the natural swinging frequency $f_N$ can be computed according to the above-presented equation 1. The decimation ratio $N_D$ can be selected so that the frequency $f_s/(N \times N_D)$ of the first transfer-zero is the same as or slightly smaller than the natural swinging frequency $f_N$. The interpolation ratio is advantageously changed together with the decimation ratio $N_D$ so as to have a constant sample rate at the output of the control device.

Figure 3:
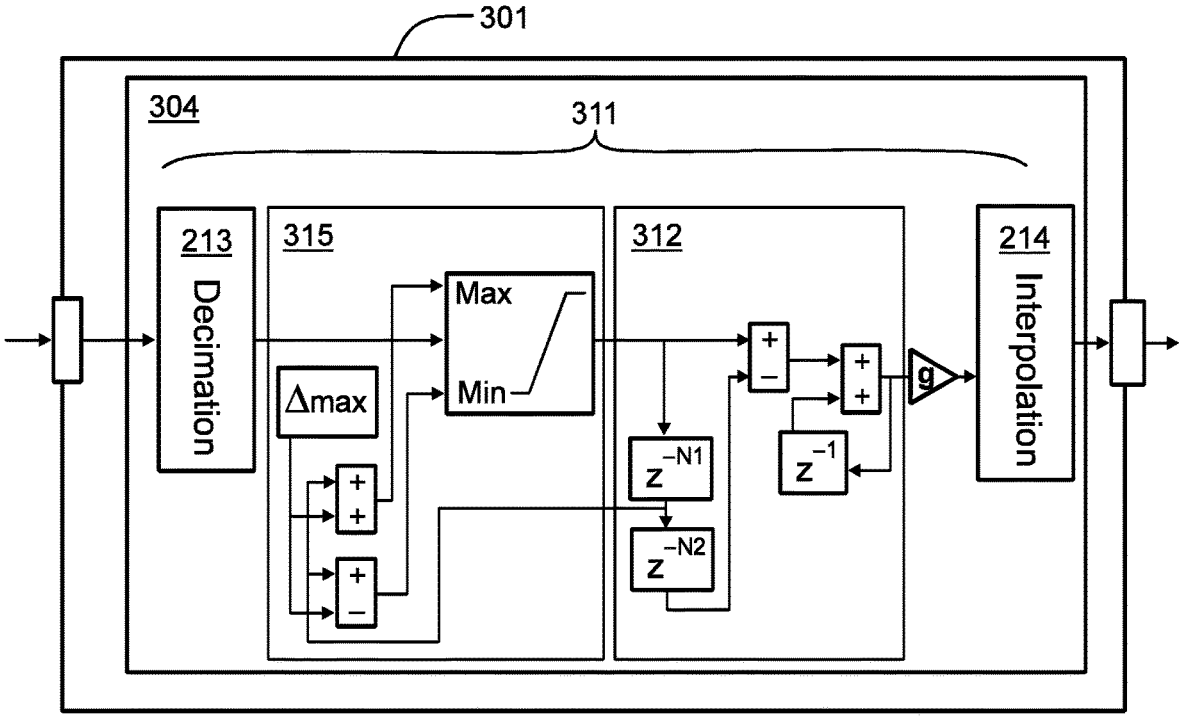
FIG. 3 illustrates a control device according to an exemplifying and non-limiting embodiment of the invention for controlling motion of a load.

FIG. 3 illustrates a control device 301 according to an exemplifying and non-limiting embodiment of the invention. The control device 301 comprises a processing system 304 constituting a signal processing path 311. In this exemplifying case, the signal processing path 311 comprises a FIR-filter 312 that is a moving average filter whose z-domain transfer function is $1+z^{-1}+z^{-2}+z^{-3}+\ldots+z^{-(N1+N2-1)}$. In this exemplifying case, the signal processing path 311 comprises an input shaper 315 for limiting a rate of change of a filter input signal supplied to the FIR-filter 312. The input shaper 315 is configured to limit an absolute value of a difference between the filter input signal and a delayed version of the filter input signal. In the exemplifying case shown in FIG. 3, the time period between the filter input signal and the delayed version of the filter input signal is N1 operating cycles of the FIR-filter 312 and the absolute value of the above-mentioned difference is limited to be at most Amax. The input shaper 315 is non-linear and thus it may create new frequency components which, in some cases, may appear at or near to the natural swinging frequency of the load. However, the FIR-filter 312 suppresses a signal component whose frequency is the natural swinging frequency and thus a possible unwanted excitation effect caused by the input shaper 315 is eliminated. Therefore, any suitable non-linear input shaper can be inserted upstream of the FIR-filter 312. Alternatively, the input shaper can also be inserted into the FIR-filter 312. In an exemplifying and non-limiting case where the signal processing path 311 comprises multiple FIR-filters, the input shaper can be inserted into a FIR-filter that is first in the direction of the signal flow. The input shaper implements 315 acceleration and deceleration ramps which can be needed e.g. during speed reversals.

Figure 4A:
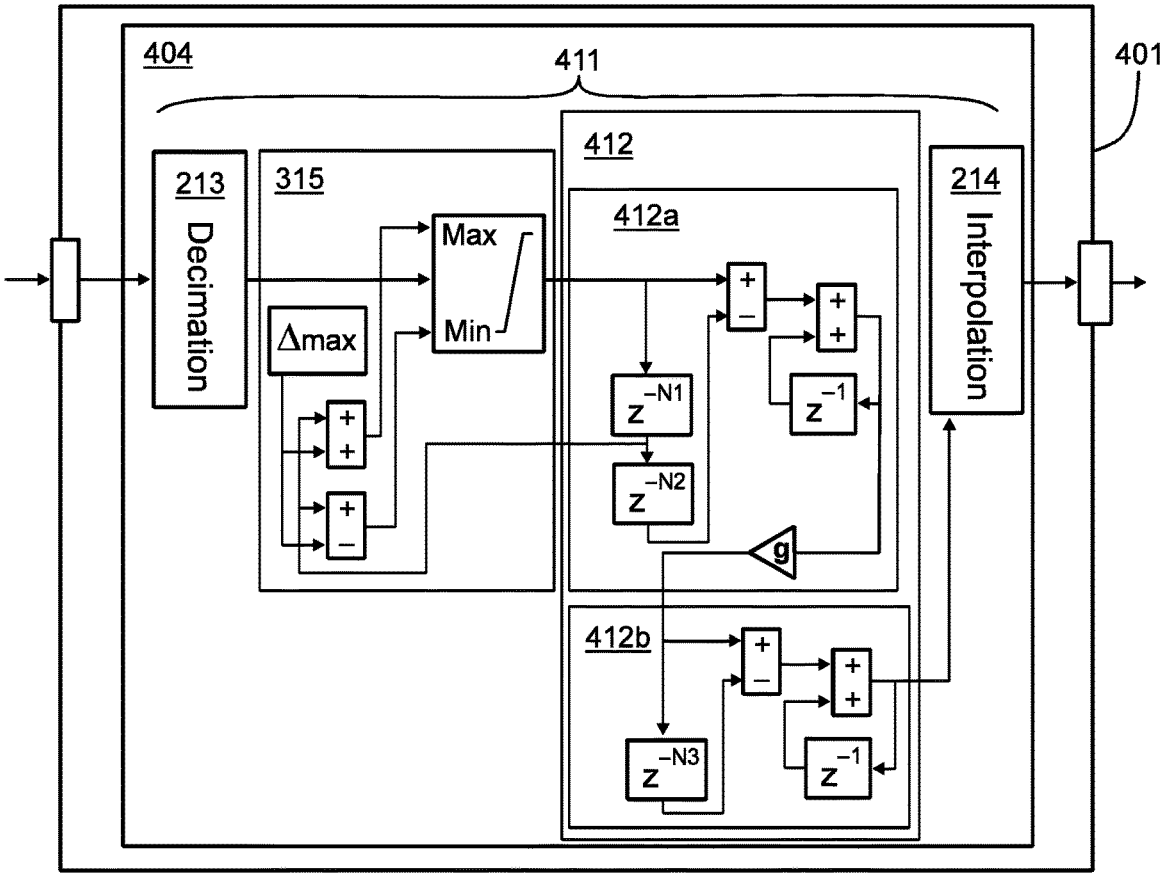
FIGS. 4*a* and 4*b* illustrate a control device according to an exemplifying and non-limiting embodiment of the invention for controlling motion of a load.

As can be seen in FIG. 2*b*, the worst-point attenuation on the first side band of the moving average FIR-filter, i.e. between the first and second transfer-zeroes, is quite small. Thus, in many cases, there is a need to change the frequencies of the transfer-zeroes in accordance with the natural swinging frequency of the load. As described above, the frequencies of the transfer-zeroes can be changed for example by tuning a decimation function carried out in front of the FIR-filter. Another approach is to use an additional filter for arranging additional attenuation on one or more frequency bands between the successive transfer zeroes of the FIR-filter. FIG. 4*a* illustrates a control device 401 according to an exemplifying and non-limiting embodiment of the invention. The control device 401 comprises a processing system 404 constituting a signal processing path 411. In this exemplifying case, the signal processing path 411 comprises a FIR-filter 412 that comprises two series-connected FIR-filters 412*a* and 412*b*. It is also possible that there are three or more series-connected FIR-filters. The impulse response of the FIR-filter 412 is the convolution of the impulse responses of the FIR-filters 412*a* and 412*b*. In the exemplifying case shown in FIG. 4*a*, the FIR-filter 412*a* is a moving average filter whose z-domain transfer function is $1+z^{-1}+z^{-2}+\ldots+z^{-(N1+N2-1)}$ and the FIR-filter 412*b* is a moving average filter whose z-domain transfer function is $1+z^{-1}+Z^{-2}+\ldots+Z^{-(N3-1)}$. In an exemplifying case, the length N1+N2 of the FIR-filter 412*a* is 100 and the length N3 of the FIR-filter 412*b* is 71, and thus the z-domain transfer function of the series connection of the FIR-filters 412*a* and 412*b* is:

$$g\frac{1-z^{-100}}{1-z^{-1}}\cdot\frac{1-z^{-71}}{1-z^{-1}},$$

where g is a gain for setting a total gain of the signal processing path 411 to be at a suitable level. The gain g can be for example 1/7100 to compensate for the DC-gains 100 and 71 of the FIR-filters 412*a* and 412*b*.

Figure 4B:
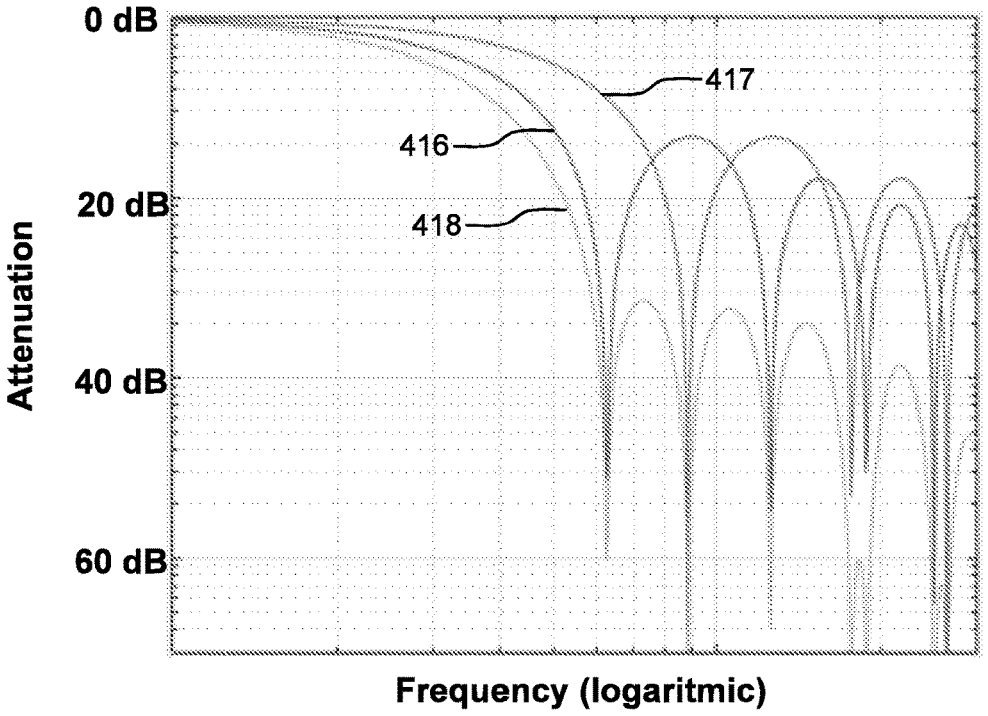

In the above-mentioned exemplifying case, the first transfer-zero of the FIR-filter 412*b* is substantially in the middle of the frequency band between the first and second transfer-zeros of the FIR-filter 412*a*. The amplitude responses of the FIR-filters 412*a* and 412*b* and the amplitude response of the series-connection of the FIR-filters 412*a* and 412*b* are shown in FIG. 4*b*. The amplitude response of the FIR-filter 412*a* is denoted with a reference 416, the amplitude response of the FIR-filter 412*b* is denoted with a reference 417, and the amplitude response of the series-connection of the FIR-filters 412*a* and 412*b* is denoted with a reference 418. In an exemplifying case where there are three moving average FIR-filters in series, the lengths of two shortest ones of the filters can be for example 0.82 and 0.62 times the length of the longest one of the filters. This selection provides good attenuation on the frequency area above the first transfer-zero of the longest one of the filters.

The impulse response of a series-connection of moving average FIR-filters is symmetric in the time domain and the impulse response can be quite long. Thus, a response latency of the control device may be too long in some cases. Therefore, in some cases it is advantageous to replace a moving average FIR-filter with a FIR-filter or with an infinite impulse response "IIR" filter whose impulse response is asymmetric in the time domain so that the impulse response has most of its energy in the beginning portion of the impulse response. The filter having the asymmetric impulse response can be for example a minimum phase-filter.

Figure 5A:
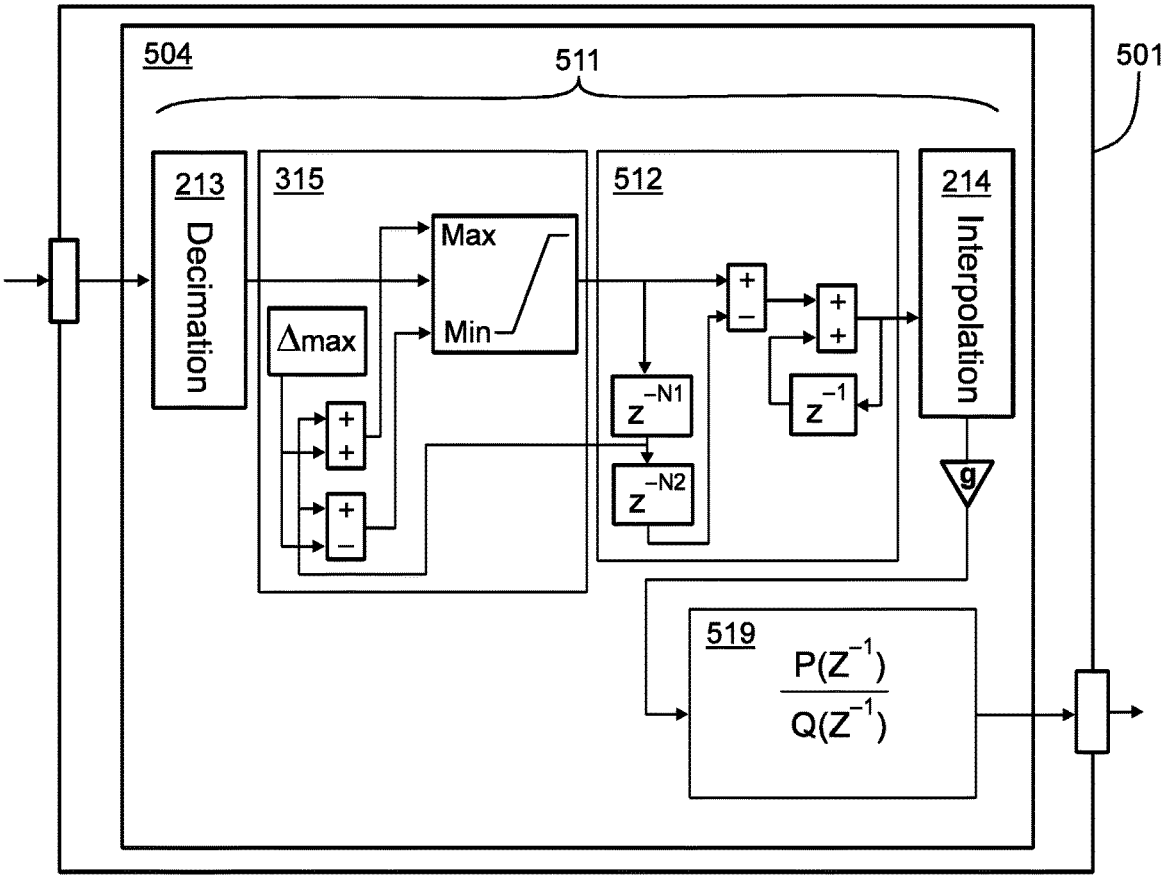
FIGS. 5*a* and 5*b* illustrate a control device according to an exemplifying and non-limiting embodiment of the invention for controlling motion of a load.

FIG. 5*a* illustrates a control device 501 according to an exemplifying and non-limiting embodiment of the invention. The control device 501 comprises a processing system 504 constituting a signal processing path 511. In this exemplifying case, the signal processing path 511 comprises a FIR-filter 512 that is a moving average filter whose z-domain transfer function is $1+z^{-1}+z^{-2}+z^{-3}+\ldots+z^{-(N1+N2-1)}$. Furthermore, the signal processing path 511 comprises a band-stop filter 519 having a stop-band on a first side-band of the finite impulse response filter 512. The band-stop filter 519 is located downstream of the interpolator 214 and thereby the sample rate of the band-stop filter 519 is the output sample rate of the interpolator 214. In FIG. 5*a*, $z^{-1}$ means a delay of one sample interval corresponding to the sample rate of the FIR-filter 512 and $Z^{-1}$ means a delay of one sample interval corresponding to the sample rate of the band-stop filter 519. The band-stop filter 519 can be for example an IIR-filter whose transfer function in the Z-domain is:

$$\frac{P(Z^{-1})}{Q(Z^{-1})}, \tag{2}$$

where $P(Z^{-1})$ and $Q(Z^{-1})$ are polynomials of $Z^{-1}$. It is however also possible that the band-stop filter is located upstream of the interpolator 214 in which case the sample rate of the band-stop filter is the same as that of the FIR-filter.

Figure 5B:
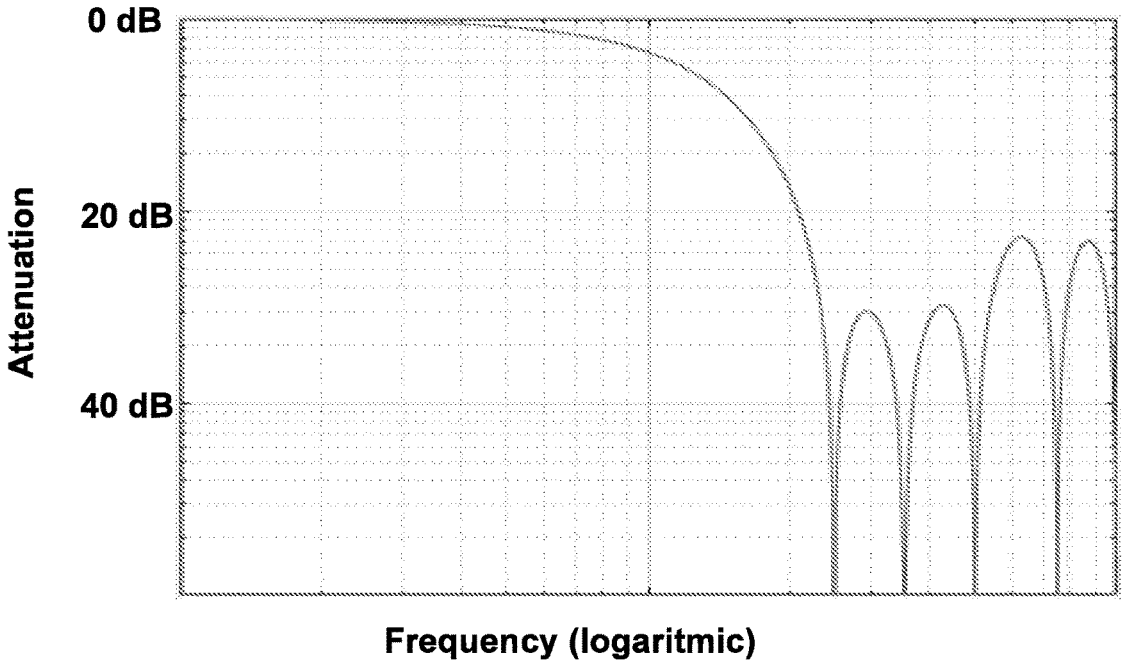

The band-stop filter 519 can be for example a time-discrete equivalent of a time-continuous filter that has the following Laplace-domain transfer function:

$$\frac{s^2+\omega_z^2}{s^2+2k\omega_z s+\omega_z^2}, \tag{3}$$

where s is a Laplace-variable, $\omega_z$ is frequency of a transfer-zero, i.e. a notch frequency, and k is a damping-factor with the aid of which the shape of the frequency response can be tuned. The damping-factor k can be tuned for example experimentally. In some exemplifying cases, it has turned out that 1.7 is a suitable value of the damping factor k. The time-continuous transfer function presented by formula 3 can be converted into its time-discrete equivalent with the aid of a suitable conversion rule. For example, the following trapezoid rule maps the left-half s-plane to the interior of an origin-centered unit-circle of the Z-plane:

$$s=\frac{2}{T}\frac{Z-1}{Z+1}, \tag{4}$$

where T is the temporal length of the sample interval corresponding to the sample rate of the band-stop filter 519. FIG. 5*b* shows the amplitude response, i.e. the absolute value of the frequency response, of the combination of the FIR-filter 512 and the band-stop filter 519 in an exemplifying case where the length N1+N2 of the FIR-filter 512 is 100 and the band-stop filter 519 is a time-discrete equivalent of a time-continuous filter whose transfer function is according to formula 3 where the notch frequency $\omega_z$ is between the first and second transfer-zeroes of the FIR-filter 512 and the damping factor k is 1.7.

It is also possible to select the notch frequency $\omega_z$ of the band-stop filter 519 to be the natural swinging frequency corresponding to the maximum rope length, and to design the FIR-filter 512 to be a moving average filter whose first transfer-zero is at a natural swinging frequency corresponding to the half of the maximum rope length. This makes the operation faster but may provide less damping at natural swinging frequencies corresponding to short rope lengths.

It is also possible to design the band-stop filter 519 directly in the Z-domain. For example, the Z-domain transfer function of a $2^{nd}$ order IIR band-stop filter can be:

$$g\frac{(1-z_zZ^{-1})(1-z_z^*Z^{-1})}{(1-z_pZ^{-1})(1-z_p^*Z^{-1})}, \tag{5}$$

where $z_z=e^{j\omega zT}$, $z_z^*=e^{-j\omega zT}$, $z_z=r_pe^{j\omega pT}$, $z_z^*=r_pe^{-j\omega pT}$, $\omega_z$ is the notch frequency, T is the temporal length of the sample interval corresponding to the sample rate of the band-stop filter 519, $r_p$ is the pole radius, $\omega_p$ is the pole frequency, j is the imaginary unit, and g is a coefficient that can be selected e.g. so that the gain at the zero-frequency i.e. the DC-gain has a desired value. As $z_z$ and $z_z^*$ are complex conjugates of each other and correspondingly $z_p$ and $z_p^*$ are complex conjugates of each other, the transfer function presented by formula 5 can be presented in a form having real-valued coefficients. The shape of the frequency response can be tuned by adjusting the pole radius $r_p$ and the pole frequency $\omega_p$.

A processing system of a control device according to an exemplifying and non-limiting embodiment of the invention, e.g. the processing systems 104, 204, 304, 404, and 504 shown in the accompanying drawings, can be implemented with one or more processor circuits, each of which can be a programmable processor circuit provided with appropriate software, a dedicated hardware processor such as for example an application specific integrated circuit "ASIC", or a configurable hardware processor such as for example a field programmable gate array "FPGA". Furthermore, the processing system may comprise one or more memory devices each of which can be for example a Random-Access-Memory "RAM" circuit.

The above-described control devices 101, 201, 301, 401, and 501 are examples of a control device that comprises:

means for receiving an input signal indicative of a target speed of a load that is non-rigidly connected to a suspension point whose speed and position are controllable, means for forming a signal processing path comprising a finite impulse response filter for suppressing a signal component whose frequency is a natural swinging frequency of the load, means for supplying the input signal to the signal processing path to produce an output signal indicative of a reference speed of the suspension point, and means for controlling motion of the suspension point in accordance with the output signal of the signal processing path.

Figure 6:
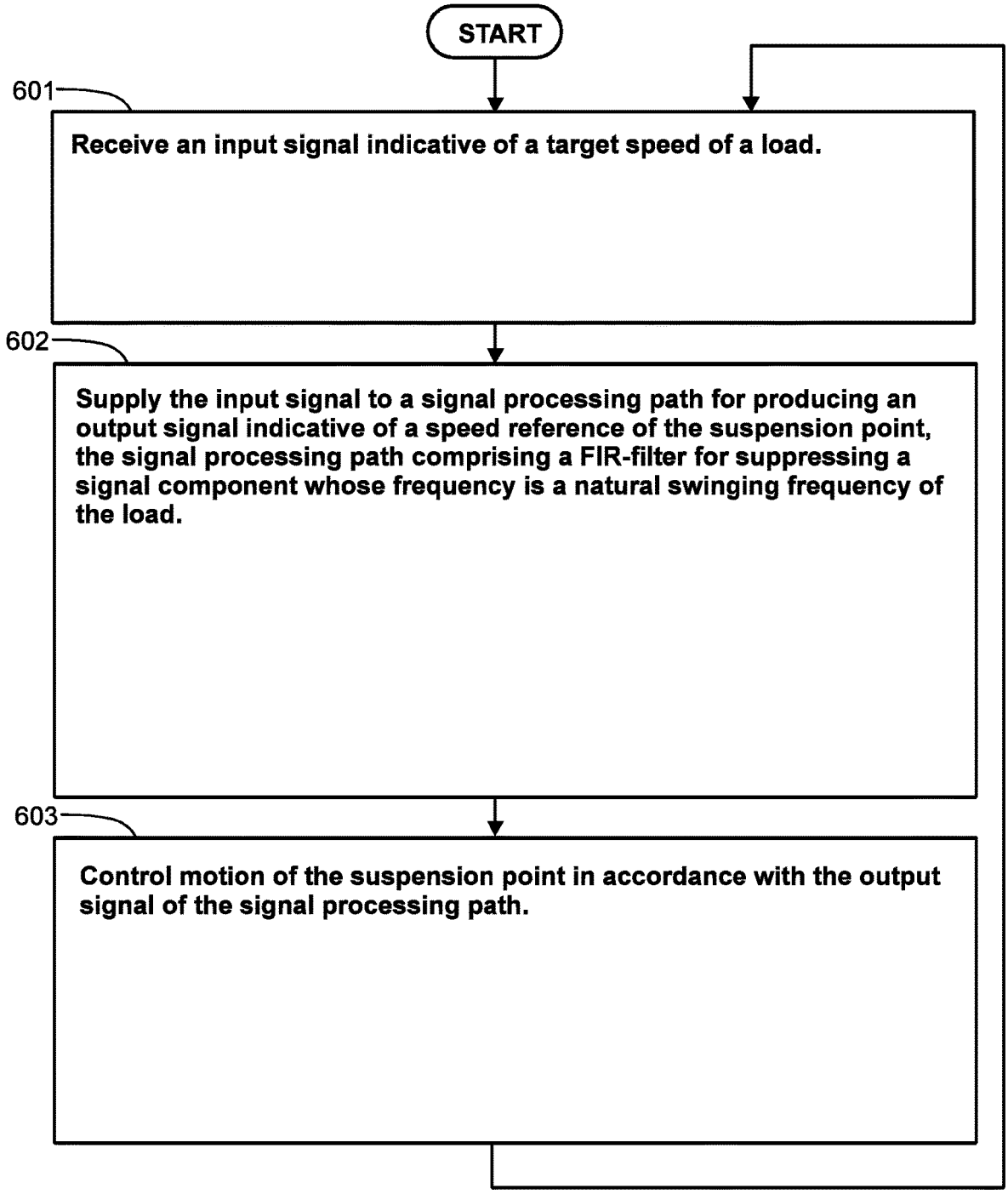
FIG. 6 shows a flowchart of a method according to an exemplifying and non-limiting embodiment of the invention for controlling motion of a load.

FIG. 6 shows a flowchart of a method according to an exemplifying and non-limiting embodiment of the invention for controlling motion of a load that is non-rigidly connected to a suspension point whose speed and position are controllable. The method comprises the following actions:

action 601: receiving an input signal indicative of a target speed of the load, action 602: supplying the input signal to a signal processing path for producing an output signal indicative of a reference speed of the suspension point, the signal processing path comprising at least one finite impulse response filter for suppressing a signal component whose frequency is a natural swinging frequency of the load, and action 603: controlling motion of the suspension point in accordance with the output signal of the signal processing path.

In a method according to an exemplifying and non-limiting embodiment of the invention, the at least one finite impulse response filter has a transfer-zero at or near to the natural swinging frequency of the load. In a method according to an exemplifying and non-limiting embodiment of the invention, the at least one finite impulse response filter comprises a moving average filter.

In a method according to an exemplifying and non-limiting embodiment of the invention, the at least one finite impulse response filter comprises at least two series, or parallel, connected finite impulse response filters. The impulse response of a series-connection of finite impulse response filters is a convolution of the impulse responses of the finite impulse response filters which are connected in series. In a method according to an exemplifying and non-limiting embodiment of the invention, the at least two finite impulse response filters comprise a moving average filter.

In a method according to an exemplifying and non-limiting embodiment of the invention, the signal processing path comprises a band-stop filter having a stop-band on a first side-band of the at least one finite impulse response filter. In a method according to an exemplifying and non-limiting embodiment of the invention, the band-stop filter is an infinite impulse response filter. In a method according to an exemplifying and non-limiting embodiment of the invention, the band-stop filter is a minimum-phase filter.

In a method according to an exemplifying and non-limiting embodiment of the invention, the signal processing path comprises a decimator in front of the at least one finite impulse response filter and an interpolator after the at least one finite impulse response filter. The decimator makes the sample rate of the at least one finite impulse response filter to be less than the sample rate of the input signal, and the interpolator makes the sample rate of the output signal to be greater than the sample rate of the at least one finite impulse response filter.

A method according to an exemplifying and non-limiting embodiment of the invention comprises receiving data indicative of the natural swinging frequency and changing the decimation ratio of the above-mentioned decimator in accordance with a change of the natural swinging frequency.

In a method according to an exemplifying and non-limiting embodiment of the invention, the signal processing path comprises an input shaper limiting a rate of change of a filter input signal supplied to the at least one finite impulse response filter. The input shaper is advantageously inserted upstream of the at least one finite impulse response filter, or the input shaper is integrated into a first one of the at least one finite impulse response filter. In a method according to an exemplifying and non-limiting embodiment of the invention, the input shaper limits an absolute value of a difference between the filter input signal and a delayed version of the filter input signal.

A computer program according to an exemplifying and non-limiting embodiment of the invention comprises computer executable instructions for controlling a programmable processor to carry out actions related to a method according to any of the above-described exemplifying and non-limiting embodiments of the invention.

A computer program according to an exemplifying and non-limiting embodiment of the invention comprises software modules for controlling motion of a load that is non-rigidly connected to a suspension point whose speed and position are controllable. The software modules comprise computer executable instructions for controlling a programmable processor to:

constitute a signal processing path comprising at least one finite impulse response filter for suppressing a signal component whose frequency is a natural swinging frequency of the load, receive an input signal indicative of a target speed of the load, supply the input signal to the signal processing path to produce an output signal indicative of a reference speed of the suspension point, and control motion of the suspension point in accordance with the output signal of the signal processing path.

The above-mentioned software modules can be e.g. subroutines and/or functions implemented with a programming language suitable for the programmable processor under consideration.

A computer program product according to an exemplifying and non-limiting embodiment of the invention comprises a computer readable medium, e.g. a compact disc "CD", encoded with a computer program according to an exemplifying embodiment of invention.

A signal according to an exemplifying and non-limiting embodiment of the invention is encoded to carry information that defines a computer program according to an exemplifying embodiment of invention.

The non-limiting, specific examples provided in the description given above should not be construed as limiting the scope and/or the applicability of the appended claims. Furthermore, any list or group of examples presented in this document is not exhaustive unless otherwise explicitly stated.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A control device for controlling motion of a load non-rigidly connected to a suspension point, the control device comprising:

an input interface for receiving an input signal indicative of a target speed of the load, an output interface for submitting an output signal indicative of a reference speed of the suspension point, and a processing system constituting a signal processing path for producing the output signal based on the input signal, wherein the signal processing path comprises at least one finite impulse response filter for suppressing a signal component whose frequency is a natural swinging frequency of the load, and wherein the signal processing path comprises a decimator in front of the at least one finite impulse response filter and an interpolator after the at least one finite impulse response filter, the decimator making a sample rate of the at least one finite impulse response filter to be less than a sample rate of the input signal and the interpolator making a sample rate of the output signal to be greater than the sample rate of the at least one finite impulse response filter.

2. The control device according to claim 1, wherein the at least one finite impulse response filter comprises more than one finite impulse response filters that are connected in series, or in parallel, with each other.

3. The control device according to claim 1, wherein the at least one finite impulse response filter has a transfer-zero at or near to the natural swinging frequency of the load.

4. The control device according to claim 1, wherein the at least one finite impulse response filter comprises a moving average filter.

5. The control device according to claim 1, wherein the signal processing path further comprises at least one band-stop filter having a stop-band on a first side-band of the at least one finite impulse response filter, the at least one band-stop filter being connected in series with the at least one finite impulse response filter, the at least one band-stop filter being arranged downstream of the at least one finite impulse response filter, and the at least one band-stop filter comprising an infinite impulse response filter.

6. The control device according to claim 1, wherein the input interface is configured to receive data indicative of the natural swinging frequency, and the processing system is configured to change a decimation ratio of the decimator in accordance with a change of the natural swinging frequency.

7. The control device according to claim 1, wherein the signal processing path comprises an input shaper for limiting a rate of change of a filter input signal supplied to the at least one finite impulse response filter, the input shaper being inserted upstream of the at least one finite impulse response filter or being integrated into a first one of the at least one finite impulse response filter that is first in a direction of a signal flow.

8. The control device according to claim 7, wherein the input shaper is configured to limit an absolute value of a difference between the filter input signal and a delayed version of the filter input signal.

9. A system for handling a load, the system comprising:

a carrier device comprising a suspension point for carrying the load non-rigidly connected to the suspension point, and a controllable drive for moving the suspension point, and a control device for receiving an input signal indicative of a target speed of the load and for supplying, to the controllable drive, an output signal indicative of a reference speed of the suspension point, wherein the control device comprises:

an input interface for receiving the input signal, an output interface for submitting the output signal to the controllable drive, and a processing system constituting a signal processing path for producing the output signal based on the input signal, the signal processing path comprising at least one finite impulse response filter for suppressing a signal component whose frequency is a natural swinging frequency of the load, wherein the signal processing path comprises a decimator in front of the at least one finite impulse response filter and an interpolator after the at least one finite impulse response filter, the decimator making a sample rate of the at least one finite impulse response filter to be less than a sample rate of the input signal and the interpolator making a sample rate of the output signal to be greater than the sample rate of the at least one finite impulse response filter.

10. The system according to claim 9, wherein the carrier device is a crane for carrying the load with a suspension rope connected to the suspension point.

11. A method for controlling motion of a load non-rigidly connected to a suspension point, the method comprising:

receiving an input signal indicative of a target speed of the load, supplying the input signal to a signal processing path for producing an output signal indicative of a reference speed of the suspension point, and controlling motion of the suspension point in accordance with the output signal of the signal processing path, wherein the signal processing path comprises at least one finite impulse response filter for suppressing a signal component whose frequency is a natural swinging frequency of the load, and wherein the signal processing path comprises a decimator in front of the at least one finite impulse response filter and an interpolator after the at least one finite impulse response filter, the decimator making a sample rate of the at least one finite impulse response filter to be less than a sample rate of the input signal and the interpolator making a sample rate of the output signal to be greater than the sample rate of the at least one finite impulse response filter.

12. The method according to claim 11, wherein the at least one finite impulse response filter comprises more than one finite impulse response filters that are connected in series or in parallel with each other.

13. The method according to claim 11, wherein the at least one finite impulse response filter has a transfer-zero at or near to the natural swinging frequency of the load.

14. The method according to claim 11, wherein the at least one finite impulse response filter comprises a moving average filter.

15. The method according to claim 11, wherein the signal processing path further comprises at least one band-stop filter having a stop-band on a first side-band of the at least one finite impulse response filter, the at least one band-stop filter being connected in series with the at least one finite impulse response filter, the at least one band-stop filter being arranged downstream of the at least one finite impulse response filter, and the at least one band-stop filter comprising an infinite impulse response filter.

16. The method according to claim 11, wherein the method comprises receiving data indicative of the natural swinging frequency and changing a decimation ratio of the decimator in accordance with a change of the natural swinging frequency.

17. The method according to claim 11, wherein the signal processing path comprises an input shaper limiting a rate of change of a filter input signal supplied to the at least one finite impulse response filter, the input shaper being inserted upstream of the at least one finite impulse response filter or being integrated into a first one of the at least one finite impulse response filter that is first in a direction of a signal flow.

18. The method according to claim 17, wherein the input shaper limits an absolute value of a difference between the filter input signal and a delayed version of the filter input signal.

19. A non-volatile computer readable medium encoded with a computer program for controlling motion of a load non-rigidly connected to a suspension point, the computer program comprising computer executable instructions for controlling a programmable processor to:

constitute a signal processing path, receive an input signal indicative of a target speed of the load, supply the input signal to the signal processing path to produce an output signal indicative of a reference speed of the suspension point, and control motion of the suspension point in accordance with the output signal of the signal processing path, wherein the computer program comprises computer executable instructions for configuring the signal processing path to comprise at least one finite impulse response filter for suppressing a signal component whose frequency is a natural swinging frequency of the load, and wherein the computer program comprises computer executable instructions for configuring the signal processing path to comprise a decimator in front of the at least one finite impulse response filter and an interpolator after the at least one finite impulse response filter, the decimator making a sample rate of the at least one finite impulse response filter to be less than a sample rate of the input signal and the interpolator making a sample rate of the output signal to be greater than the sample rate of the at least one finite impulse response filter.

* * * * *